US006485373B1

(12) United States Patent
Stephens

(10) Patent No.: US 6,485,373 B1
(45) Date of Patent: Nov. 26, 2002

(54) SPORTNET

(75) Inventor: Roger A. Stephens, 5320 Nyoda Way, Carmichael, CA (US) 95608

(73) Assignee: Roger A. Stephens, Carmichael, CA (US)

( * ) Notice: Subject to any disclaimer, the term of this patent is extended or adjusted under 35 U.S.C. 154(b) by 0 days.

(21) Appl. No.: 09/552,175

(22) Filed: Apr. 18, 2000

Related U.S. Application Data

(60) Provisional application No. 60/134,042, filed on May 14, 1999.

(51) Int. Cl.[7] ..... A63B 57/00; A63B 69/63

(52) U.S. Cl. ..... 473/197; 473/162

(58) Field of Search ..... 473/415, 197, 473/163, 190, 454, 476, 478; 273/400

(56) References Cited

U.S. PATENT DOCUMENTS

| | | | | | |
|---|---|---|---|---|---|
| 1,540,670 | A | * | 6/1925 | Vidmer | 473/190 |
| 1,669,640 | A | * | 5/1928 | Warlick | 473/163 |
| 3,127,692 | A | * | 4/1964 | Adleberg | 43/7 |
| 3,227,449 | A | * | 1/1966 | Schwab | 473/439 |
| 3,558,140 | A | | 1/1971 | Romeo | 273/181 |
| 4,153,246 | A | * | 5/1979 | Byrne | 473/197 |
| 4,511,146 | A | | 4/1985 | Windall | 273/185 |
| 4,905,996 | A | | 3/1990 | Tallent | 273/401 |
| 5,116,056 | A | * | 5/1992 | Schmutte | 473/172 |
| 5,205,564 | A | | 4/1993 | Lamberti | 273/400 |
| 5,269,527 | A | | 12/1993 | Noval | 273/411 |
| 5,409,230 | A | * | 4/1995 | Dunaway et al. | 473/161 |
| 5,452,896 | A | | 9/1995 | Core | 273/26 A |
| 5,467,990 | A | | 11/1995 | Kitzhaber | 273/181 |
| 5,492,319 | A | | 2/1996 | Lee | 273/181 |
| 5,524,901 | A | * | 6/1996 | Bison et al. | 473/197 |
| 5,664,784 | A | * | 9/1997 | Redlich et al. | 273/396 |
| 5,730,442 | A | * | 3/1998 | Anderson | 273/400 |

* cited by examiner

*Primary Examiner*—Paul T. Sewell
*Assistant Examiner*—M Chambers

(57) ABSTRACT

A multiple sport practice apparatus which permits a person to engage in the repetitive striking of such objects at any position, even in a relatively confined location, so as to tone the required muscles, develop muscle memory of the proper motion, and develop the proper execution of the striking motion. The multiple sports practice apparatus includes, a secondary safety net section used as a back up for stray balls, and a impact net section used as the primary target so that projectile that has impinged upon falls to the base of apparatus. The apparatus is arranged to stop the flight of a ball that is incident thereon, and is suspended in Four Corners, to a structure such as rafters or walls in a garage or warehouse, but not limited to. The two nets making the apparatus gather as they rest on playing surface to form a seal at the bottom to catch balls directed toward apparatus. Balls are restrained and caught by the apparatus and laid to rest on playing surface. Gathered portion of nets also acts as a deterrent to ball rolling while on the playing surface.

1 Claim, 6 Drawing Sheets

SPORTNET

This application claims the benefit of provisional application No. 60/134,042 filed on May 14, 1999.

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

1) Field of Invention

The present invention relates generally to recreational games and, more particularly, to a multiple-sport apparatus that finds particular utility in the play of games of golf, baseball, tennis, football, and soccer but not limited to. The apparatus of the present invention is especially suitable for use as a practice device which enables a person to repetitively practice, resulting in a realistic resistance and flight of the ball and a quick dampened return of the object to the playing surface.

The apparatus can be used in any area where it may be suspended to a structure, such as in a building or garage of a house. The apparatus can easily be stored when not in use. Balls directed toward the apparatus are restrained from causing damage to walls and other adjacent objects.

In order to practice sports, athletes typically go to a designated area, which can be a considerable distance from the athlete's home, and are often inaccessible or impractical to use due to poor weather conditions. The apparatus disclosed herein permits athletes to practice his or her ball sport at home or some other location, without concern for weather conditions, traffic, and convenience.

2) Description of the Related Art

Various devices for practicing sports have been developed over the years. However, the device shape, is different from the one in this application.

For Example, U.S. Pat. No. 3,558,140, issued to Romeo on Jan. 26, 1971, discloses a golf practice apparatus, which simulates a putting green. The apparatus comprises a backdrop, which depicts a putting green and has slits along the lower and side boundaries of the green so that a golf ball hitting the target area will pass through the slit and drop into a collection trough.

For Example, U.S. Pat. No. 4,511,146, issued to Windall on Apr. 16, 1985, discloses a practice golf net, which is suspended from a frame and contains a mechanism to signal the impact strength imparted to the ball, the direction the ball takes, and the loft that the ball assumes after being struck.

For Example, U.S. Pat. No. 4,905,996, issued to Tallent on Mar. 6, 1990, discloses a ball and target net game apparatus is set forth wherein a target net includes a perimeter framework securing a generally planar net wherein the frame work includes a plurality of forwardly extending horizontal legs and associated bracing to maintain the netting in a secure arrangement in use. The framework and the legs of the apparatus are telescoping to effect a compact structure easily stored when not in use. An inner net is selectively securable to spaced elongate straps longitudinally secured relative to the main net portion of the apparatus to provide a target in variable orientation relative to the main net.

For Example, U.S. Pat. No. 5,205,564, issued to Lamberti on Apr. 27, 1993, discloses a ball catching net apparatus, which has a back net from which extends, in a parallel relationship, sidewalls with a top wall interconnecting between the parallel sidewalls. The top wall, sidewalls and the back wall define a ball confining area. Within this ball confining area is located a pair of downwardly extending nets which are mounted on a mounting frame. Each of the downwardly extending nets can be used separately or together in order to achieve maximum absorption of the energy from the ball that is being directed into these nets.

For Example, U.S. Pat. No. 5,269,527, issued to Noval on Dec. 14, 1996, discloses a net support assembly for training and practicing sports, which use sports projectiles, is disclosed. The assembly is lightweight, easy to setup, portable, and versatile. A shock-corded segmented fiberglass pole formed into an arch is supported from the ground or other fixed support structure. A durable extra long nylon net is loosely draped within the arch to receive and dissipate the energy of any sports projectiles (e.g. golf balls, soccer balls, baseballs, footballs, etc.) which may be directed into the net. The flexible movement of the top of the arch also helps to dissipate the energy.

For Example, U.S. Pat. No. 5,452,896, issued to Core on Sep. 26, 1995, discloses a sports practice cage is disclosed. U-shaped side frames attach to a solid flat cage base, and horizontal poles connect the side frames to form the basic cage frame. Netting is suspended from the cage frame, with one side of the. cage left open, so that a five-sided chamber is formed. A platform is connected to the cage base at the open end of the chamber, and a tee may be mounted on the platform. In an alternate embodiment the platform is a golf platform, and a golf tee pad is attached to the golf platform.

For Example, U.S. Pat. No. 5,467,990, issued to Kitzhaber on Nov. 21, 1995, discloses a practice net for arresting golf balls hit from a golf tee on a practice mat. The device includes a frame having a first net and a second net relatively, orthogonally oriented, with a practice mat attached between the nets. A left-handed tee is positioned across from the first net and a right-handed tee is positioned across from the second net. Thus, the device may be utilized by either left or right-handed golfers. In addition, a pair of lateral nets flank the first and second nets, and a pair of overhead nets extend from the first and second nets to further contain errant golf balls.

For Example, U.S. Pat. No. 5,492,319, issued to Lee on Feb. 20, 1996, discloses a indoor golf chip shot practice apparatus which is to be used for practicing chip shots in the game of golf. The apparatus comprises a rectangular prism shape safety net with only one opening to the side of the user, therefore, the golf ball stays inside of the safety net even in case of bad shots. The apparatus also comprises a frame to support and encompass the safety net and is designed in such a way that the golf ball rolls back on the floor of the safety net to the user after each shot.

Additionally, various means for suspending sheets of fabric and other materials from overhead support structures have been developed.

For Example, U.S. Pat. No. 4,793,399 issued to Pryor on Dec. 27, 1988, discloses a hanger assembly for suspending an article or articles such as a curtain or other flexible sheet material below a support rail, said support rail containing a channel such that the material which is supported can be moved to different positions relative to the ends of the support rail.

The foregoing patents and publications reflect the state of the art of which the applicant is aware and are tendered with the view toward discharging applicant's acknowledged duty of candor in disclosing information which may be pertinent in the examination of this application. It is respectfully stipulated, however, that none of these patents or publications teach or render obvious, singly or when considered in combination, applicant's claimed invention.

BRIEF SUMMARY OF THE INVENTION

This invention pertains to a multiple sport practice apparatus, which is suspended from a structure or other objects suitable for suspending.

The apparatus comprises of rectangular sheet of material, which covers the top and is suspended along its top edge and extends in a downward direction toward the playing surface. The length of the vertical sides are longer than the distance between the top edge and playing surface so that the bottom of the net gathers to form a seal with the playing surface to catch the balls directed towards the apparatus.

The apparatus is suspended from a structure such as the garage or warehouse rafters and can be tied to an eyebolt or any other item suitable for suspending apparatus.

A rope or other suitable material can be tied to a grommet in the top edge of the apparatus. The four corners representing the irregular rectangle is where grommets are positioned for suspending the apparatus.

The apparatus can be retracted to a horizontal position when not in use by simply pulling a rope and securing the rope by means of a rope cleat.

Balls, which hit the apparatus, drop into the gathered bottom of the net and are thereby prevented from rolling around the playing surface. Low flying balls are prevented from rolling under the net by the seal with the playing surface created by the gathering of excess netting at the bottom of the net.

An object of the invention is to provide an apparatus for practicing sports, which require a ball and have use of capturing a ball for purpose of practice, such as golf, baseball, tennis, etc. indoors or outdoors, provided a structure where apparatus may be supported.

Another object of the invention is to provide an apparatus, which can be easily stored when not in use, without disassembly.

Another object of the invention is to restrain balls, which are impinged upon.

Another object of the invention is to be suspended without the need for a frame supporting the top edges of the apparatus.

Another object of the invention is to restrain balls, more specifically golf balls, from rolling around the playing surface after apparatus restrains them. The balls gather at bottom edge of apparatus.

Another object of the invention is to prevent balls, which are hit at low angles from rolling under the net.

Another object of the invention is to restrain balls, more specifically golf balls, which are hit off of the "toe" of "shank" of a golf club.

Further objects and advantages of the invention will be brought out in the following portions of the specification, wherein the detailed description is for the purpose of fully disclosing preferred embodiments of the invention without placing limitations thereon.

BRIEF DESCRIPTION OF SEVERAL VIEWS OF THE DRAWING(S)

The invention will be more fully understood by reference to the following drawings, which are for illustrative purposes only:

DETAILED DESCRIPTION OF THE INVENTION

The multiple sport, ball practicing arrangement of the present invention is useful in improving one's skill in games which involve the striking of an object such as a golf ball, baseball, soccer ball, softball, tennis ball, hand ball, or racket ball, with a striking instrument such as a club, racket, or bat, one's foot, hand or skills of throwing and kicking are required. The device of the present invention permits a person to engage in the repetitive striking of such object, even in a relatively confined location, so as to tone the required muscles, develop muscle memory of the proper motion, and develop the proper execution of the striking or other motions, which require muscle memory to develop skill.

Figure 1:
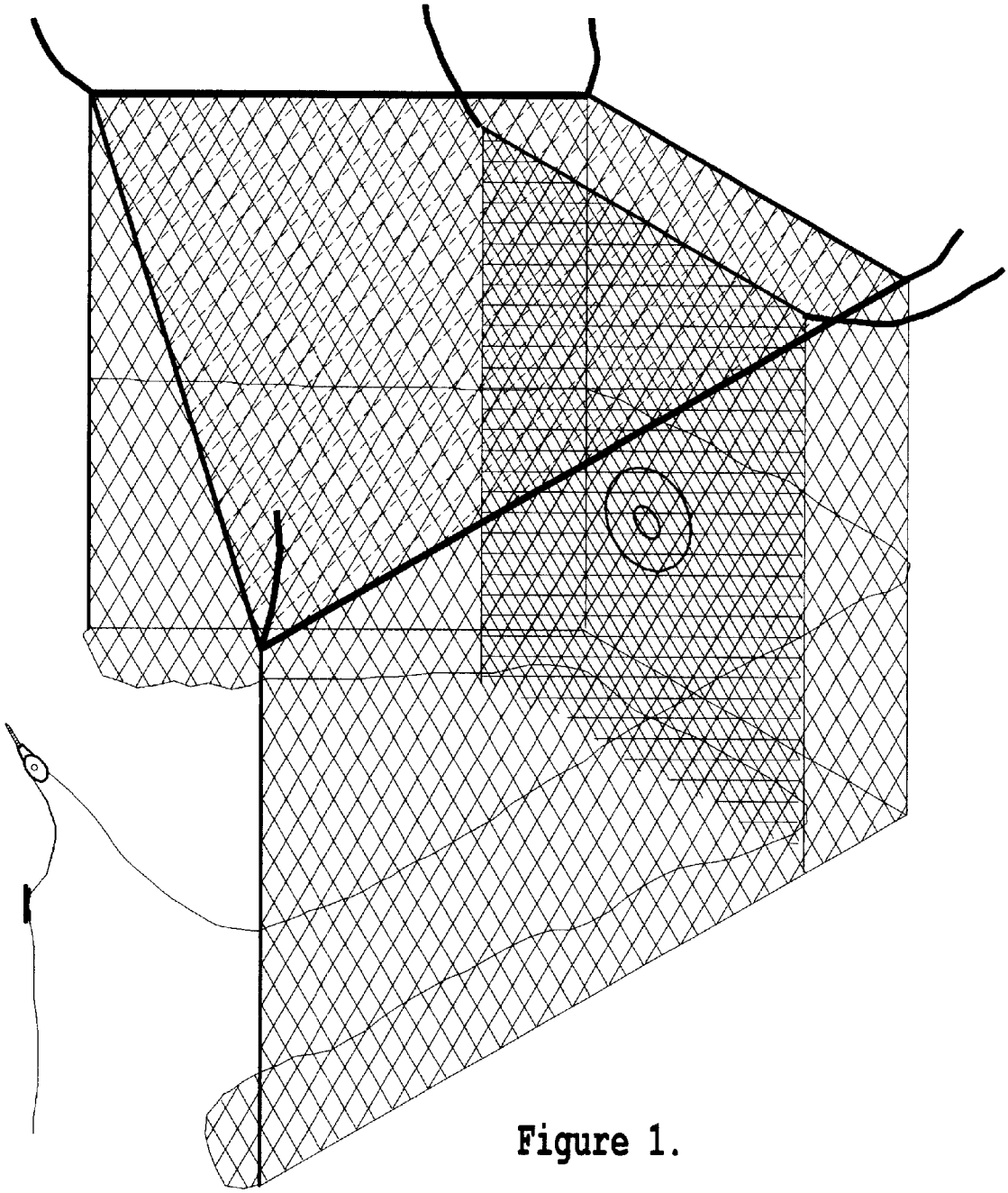
FIG. 1 is a perspective view of a preferred embodiment of the invention.

Referring more specifically to the drawings, for illustrative purposes a preferred embodiment of the present invention is shown in FIG. 1. It will be appreciated that the apparatus may vary as to configuration and as to details of the parts without departing from the basic concepts as disclosed herein.

Figure 2:
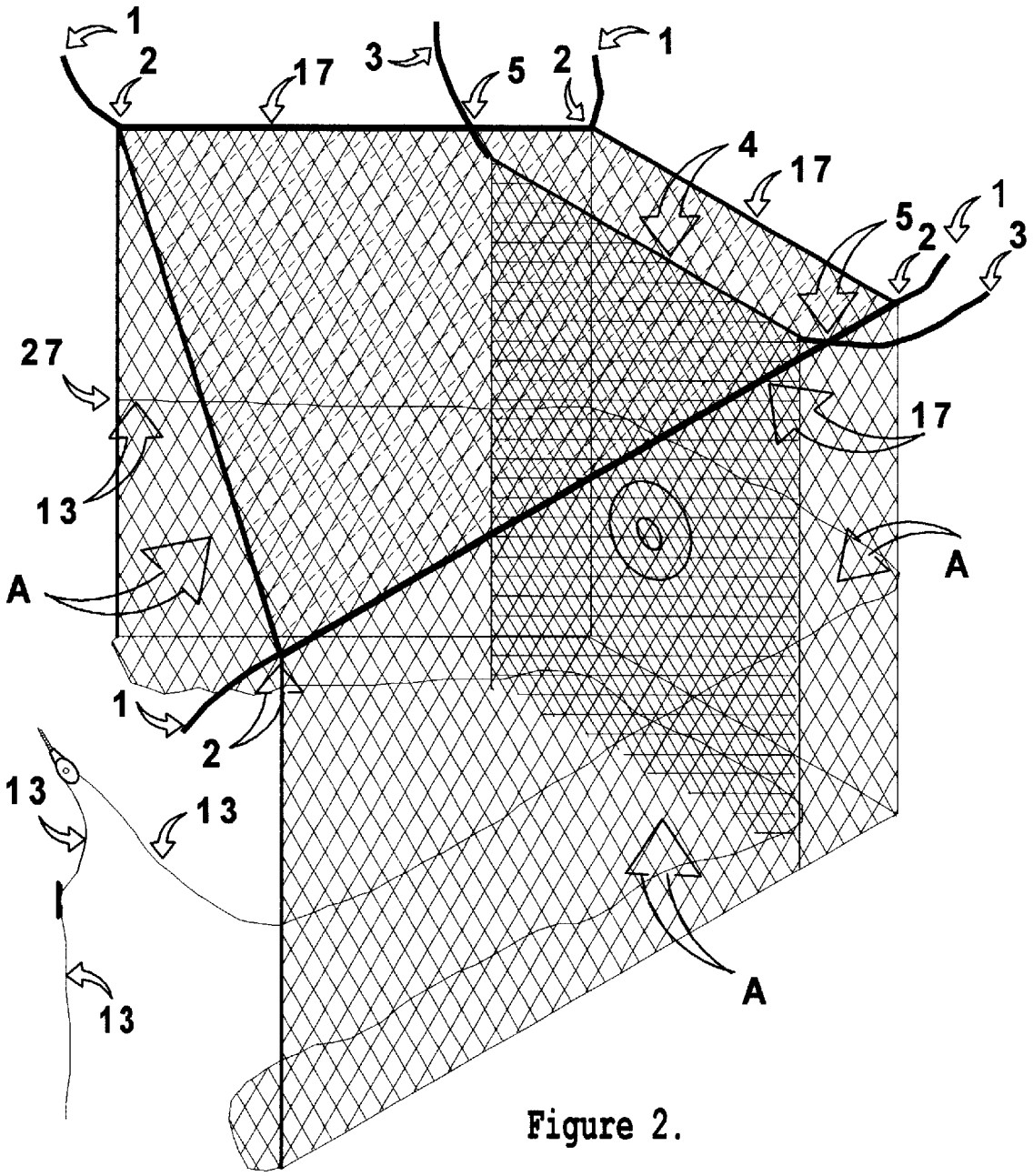
FIG. 2 is a perspective view of the apparatus depicted in FIG. 1 with the details of the retraction system used for suspending apparatus to horizontal position when not in use.

Referring to FIG. 2, the apparatus is suspended from an overhead support structure by rope 1 or other suitable material, for ease of installation and construction, these materials 1 are tied to safety net where grommets are located in corners 2, grommets are installed in the reinforced top edge 17 of safety net. The grommets have an opening of sufficient size so as to accept these materials.

Referring to FIG. 2, the safety net portion of the apparatus is defined by the topside (B) and the three vertical sides (A). The three vertical sides extending down to playing surface. The primary portion which projectiles are impinged upon is the impact net (C). The impact net C is placed in front of the safety net.

Referring to FIG. 2, the two vertical open sides of the safety net are reinforced with material 18.

Referring again to FIG. 2, the apparatus can easily be stored when not in use by pulling rope 13 until apparatus is lifted to horizontal position. This is easily accomplished since the rope slides through the swivel pulley 14 installed to an overhead structure but not limited to overhead structures. The rope line 16 weaves in and out of net openings and is tied to left edge of net 27. When safety net is pulled by rope 13 the lower half of netting portion (A) is folded into upper portion supported by the tension caused by rope pulling net against top reinforced portion of netting 17. Rope freely slides in pulley 14 and is secured by a single rope cleat 15 mounted on vertical surface such as wall but not limited to. This is an important feature for ease of storage and where space is needed underneath apparatus when not in use.

Figure 3:
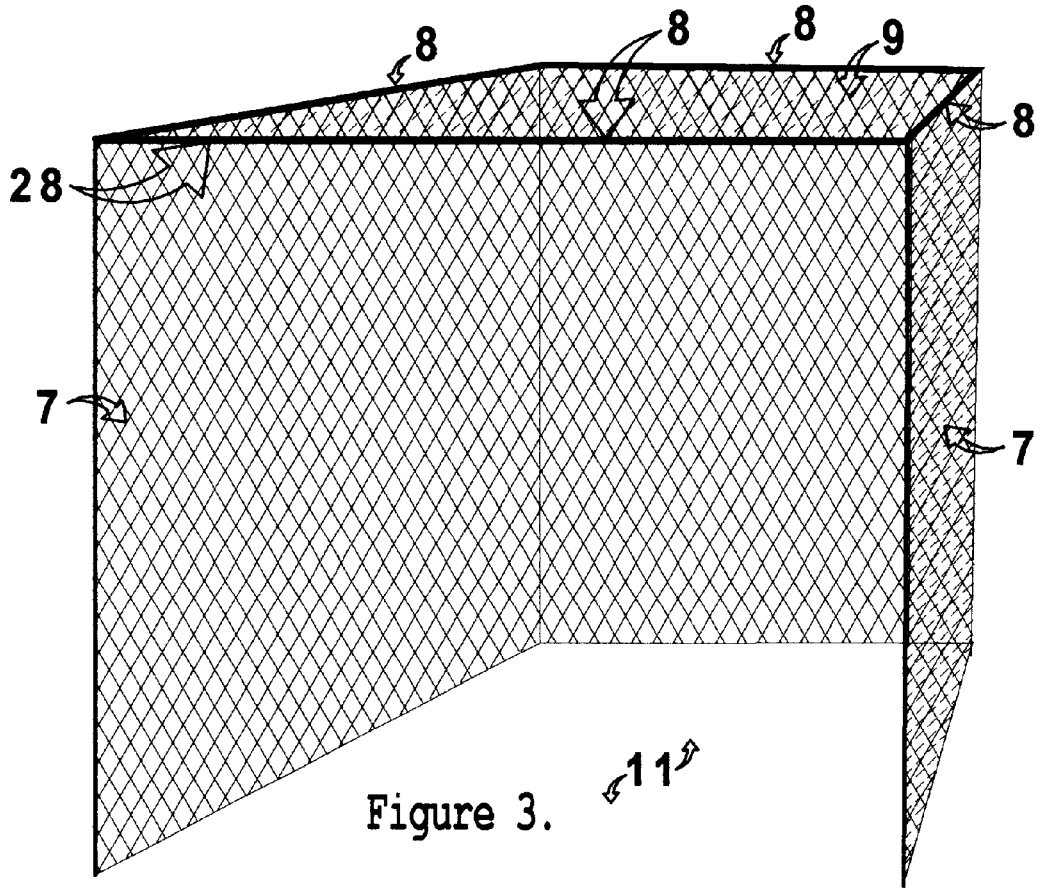
FIG. 3 is a front view of the safety net depicted in FIG. 1 showing a manufactured view with net in full length not gathered on playing surface. This view also shows the different side of safety net.

Referring to FIG. 3, assembly 7 is one section of netting having an openwork pattern to its weave, the openings in which are sufficiently small enough to prevent a ball the size of a golf ball from passing through it. This section also contains three different vertical planes which make two sides and back of safety net.

Referring again to FIG. 3, the top edge 7, which is sewn and reinforced with material 8 to top 9 thus enclosing three side and top of safety net.

The safety net consists of two pieces of netting. (1) piece for the right, back, and left sides 7, and (2) one piece for the top side 9, these pieces are joined by material 8 on all sides that intersect at planes, thus constituting the top reinforced top edge of safety net. The leading edge 28 of the top portion of safety net is also reinforced with material.

Figure 4:
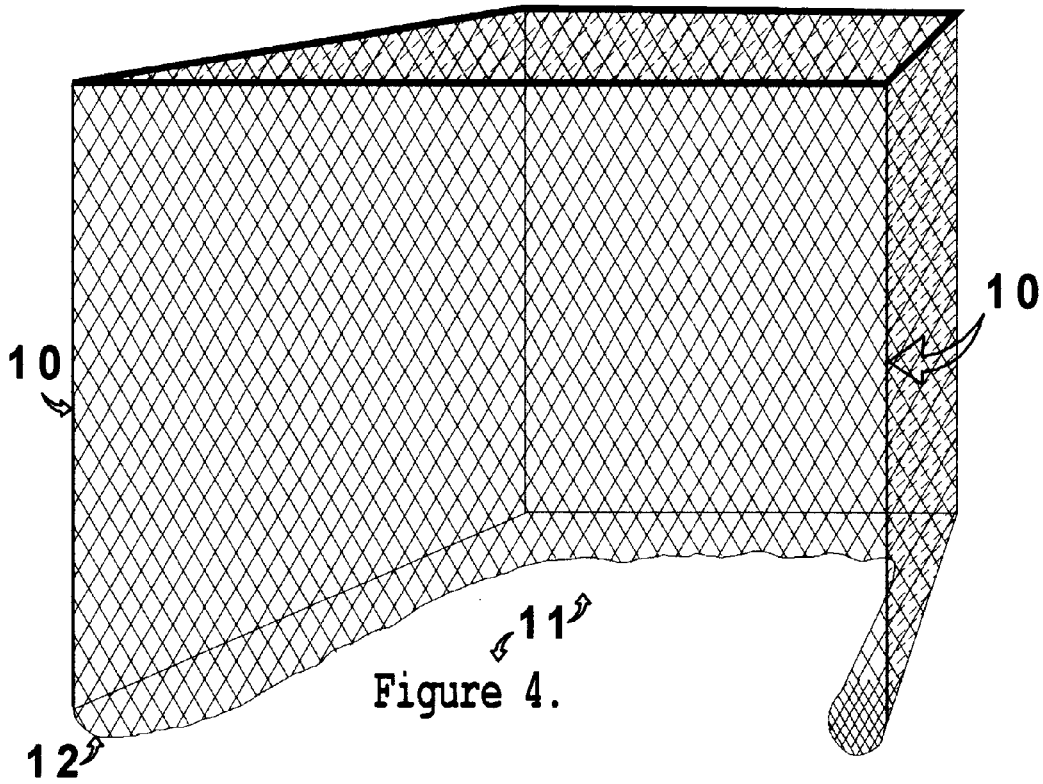
FIG. 4 is a front view of the safety net depicted in FIG. 1 showing an installed view with net gathered on playing surface to forming e seal to prevent ball from passing through safety net.

Referring to FIG. 3 and FIG. 4, the length of net 7 is greater than the recommended maximum installed height of the safety net top edge 8 above playing surface 11 so that the bottom edge of net 7 can be gathered back onto itself 12.

Referring again to FIG. 3 and FIG. 4, the gathering of the net 12, has three significant functions. First, gathering 12 forms a seal between net 7 and playing surface 11. This configuration prevents balls, which are directed at a low angle toward net 12 from rolling beneath net assembly 7. Second, gathering the bottom edge of net 12 will also add weight to the bottom of net assembly 7 thereby taking up the slack and giving a stabilizing effect to 7. Third, gathering 12 prevents longitudinally along the bottom of net 7 which catches balls restrained by net 7 and can also prevent balls (such as golf balls) from rolling around playing surface 11 when they fall after being restrained by apparatus.

Referring to FIG. 4, the leading edges of the net making vertical planes 10 to playing surface 11, is also reinforced with material.

Figure 5:
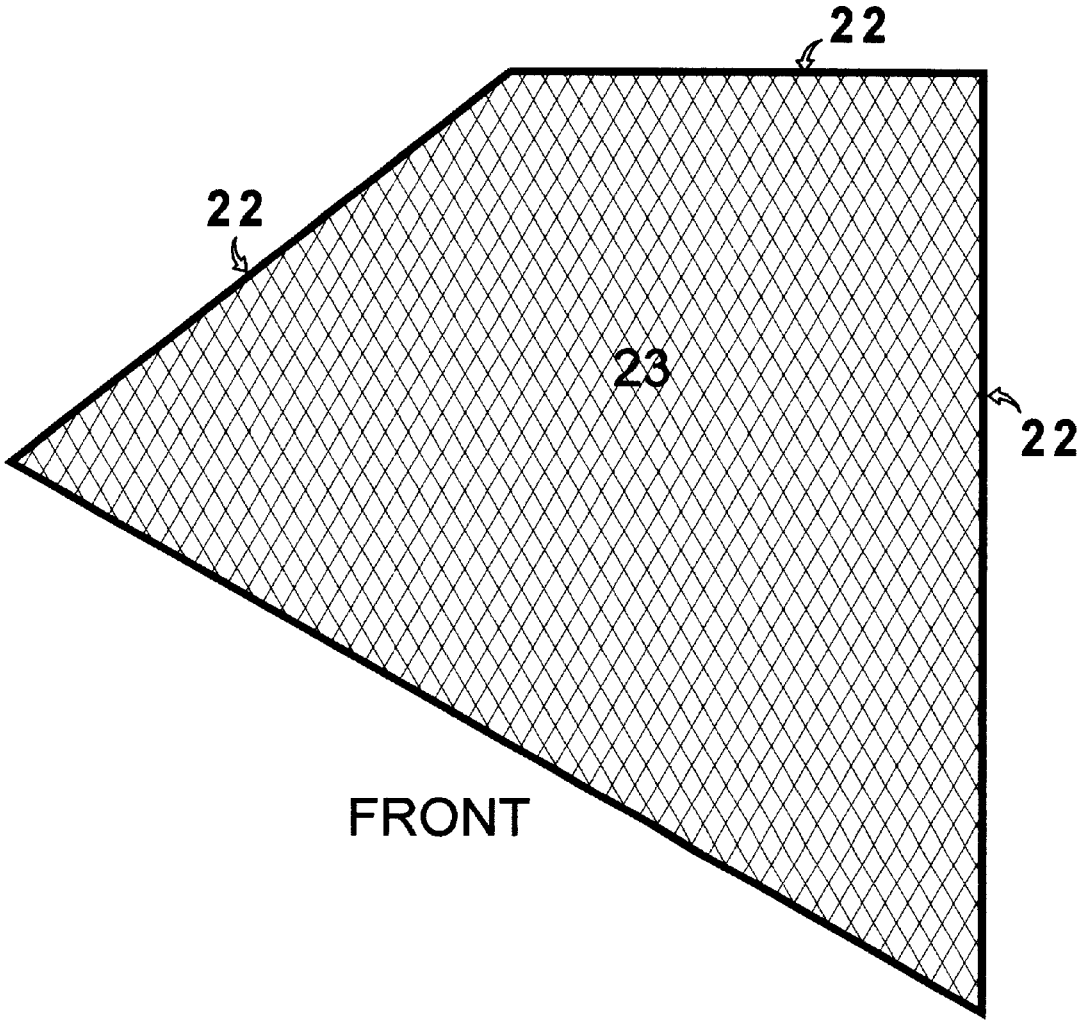
FIG. 5 is a top view of the irregular shape of safety net depicted in FIG. 1 shown looking down from above.

Referring to FIG. 5, this represents a top view of the safety net only. Notice the irregular rectangular shape of safety net. This is to allow for maxim protection on all three vertical sides 22 and top horizontal side 23 such as a golf ball struck with a high trajectory or off the toe or heel of club for right handed players or a football kicked high would be restrained by top portion of safety netting. I would be made in reverse for left handed players.

Figure 6:
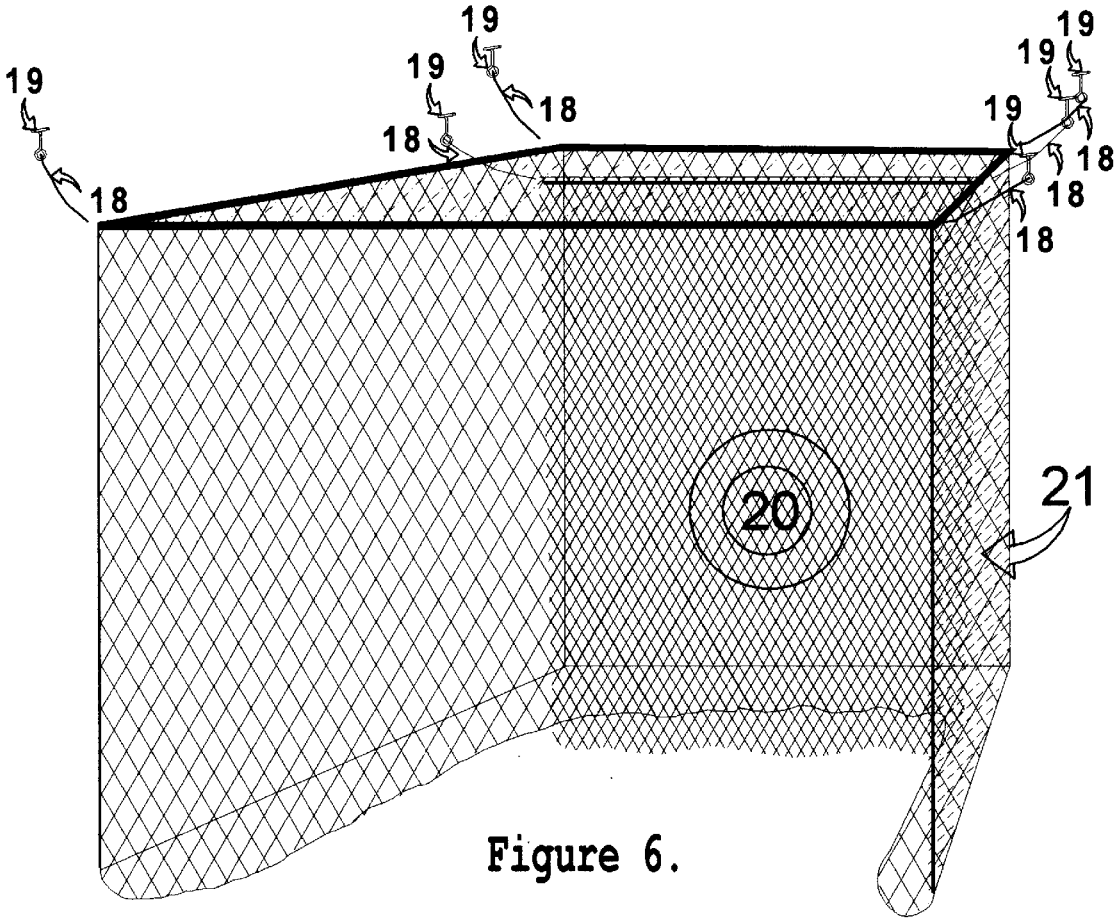
FIG. 6 is a front view of a complete embodiment of the apparatus depicted in FIG. 1 showing the two nets joined to make the complete apparatus.

Referring to FIG. 6, shows examples of how the apparatus could be installed securing rope 18 to an alternative embodiments of the apparatus where support rope is attached to an eyebolt 19, which can be screwed to overhead structure (i.e. a garage ceiling rafter). Referring again to FIG. 6, this embodiment is distinctly advantageous in that a golf ball that is hit off of the "toe" of the club head (e.g., sliced) is still restrained. In normal play, player directs balls toward the impact net portion of apparatus 20 that is positioned in front of back of safety net. If player is practicing golf and balls, which are sliced "deviate from their intended course toward right side 21 where they are still restrained by apparatus.

Figure 7:
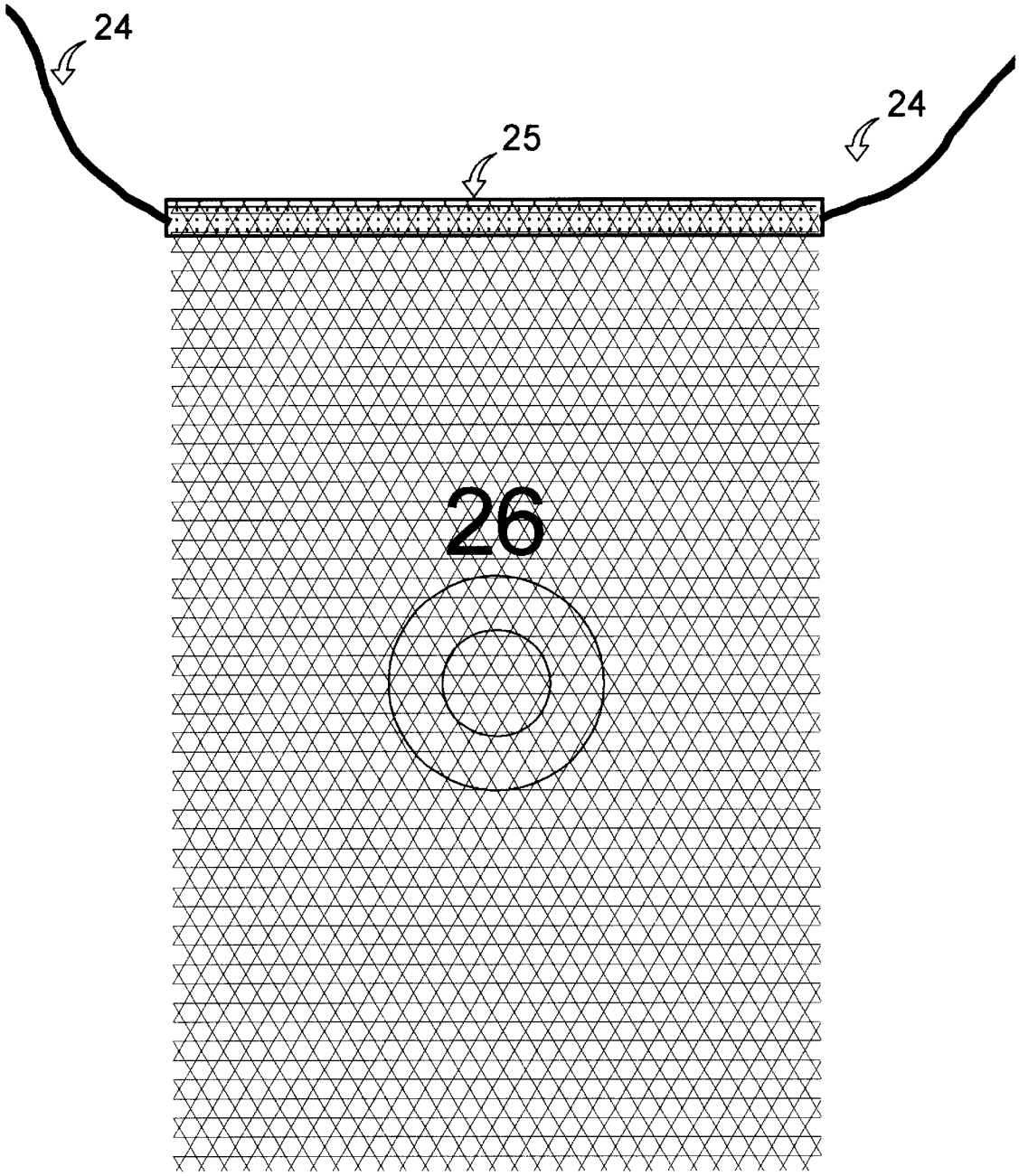
FIG. 7 is a front view of impact net depicted in FIG. 1 showing the manufactured full-length view.

Referring to FIG. 7, this drawing represents the impact net used in the embodiment of FIG. 1 as the primary target. This impact net reinforced top edge 25 is made of reinforced material. A rope 24 is sewn through the reinforced material extending out both sides 24 for securing to a structure or to the safety net top edge FIG. 2, 17.

Referring again to FIG. 7, the impact net 26 is made of mesh small enough not to allow a ball the size of a golf ball not to pass through.

When the apparatus is not in use or when in a garage normal vehicular access is required, the apparatus can be stored horizontal next to structure supporting it. These alliterative embodiments can also be used for installing the apparatus in other locations.

Being evident that the foregoing embodiment assumes a right handed player, for left-handed players said practice apparatus is built in reverse.

To use the apparatus person stands position facing the opening of net and direct ball in a manner where apparatus can restrain ball and lay to rest on playing surface.

Although the description above contains many specificities, these should not be construed as limiting the scope of the invention but as merely providing illustrations of some of the presently preferred embodiments of this invention.

I claim:

1. A sports apparatus, to limit flight of a projectile that is thrown or hit in a sports activity comprising:

(a) an irregular rectangular shaped safety net, said safety net having openwork weave pattern through which a ball the size of a golf ball cannot pass;

(b) an impact net, said impact net comprising a fine mesh and is the primary target which ball is impinged upon;

(c) a retraction system, said retraction system is used for storing apparatus in a horizontal position when not in use;

the safety net further comprising:

(d) three vertical sides, with the longest vertical side forming a right angle to the shortest vertical side, said shortest vertical side forming a 45 degree angle inward to the third side, and the fourth side open to allow projectiles to be impinged upon said three vertical sides;

(e) a top, said top is joined to vertical side to restrict projectiles from escaping and allowing a swinging object such as a club used in the sport of golf to exit without getting caught in said safety net;

(f) said three sides are longer than the distance from top edge to ground;

(g) a twine, said twine is woven in and out of safety net half way from the ground to said top edge, and is tied to opposite side and used for selectively retracting apparatus in a horizontal position when not in use, said twine forms a pocket when pulled and secured for bottom half of said apparatus to fold into and stay tucked away when not in use.

* * * * *